US006426456B1

(12) United States Patent
Khawand et al.

(10) Patent No.: US 6,426,456 B1
(45) Date of Patent: Jul. 30, 2002

(54) METHOD AND APPARATUS FOR GENERATING PERCUSSIVE SOUNDS IN EMBEDDED DEVICES

(75) Inventors: Jean Khawand, Miami; Radu Frangopol, Plantation, both of FL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 10/012,273

(22) Filed: Oct. 26, 2001

(51) Int. Cl.[7] ..... G10H 1/057; G10H 1/08; G10H 1/12

(52) U.S. Cl. ..... 84/624; 84/625; 84/627; 84/DIG. 9; 84/DIG. 12

(58) Field of Search ..... 84/622–625, 627, 84/605, 660, 661, 663, 696–700, 702, 703, 736, 738, DIG. 9, DIG. 12

(56) References Cited

U.S. PATENT DOCUMENTS 3,972,258 A * 8/1976 Adachi ..... 84/DIG. 12
4,181,059 A * 1/1980 Weber ..... 84/DIG. 12
4,270,430 A * 6/1981 Deutsch ..... 84/625 X
4,327,419 A * 4/1982 Deutsch et al. ..... 84/605 X
4,736,663 A * 4/1988 Wawrzynek et al. ..... 84/DIG. 9
5,157,216 A * 10/1992 Chafe ..... 84/697 X

* cited by examiner

*Primary Examiner*—Stanley J. Witkowski
(74) *Attorney, Agent, or Firm*—Scott M. Garrett

(57) ABSTRACT

A percussive sound contains both harmonic and non-harmonic frequency spectral content. To reproduce a particular percussive sound, such as the sound of a drum or cymbal or hand clap, for example, the harmonic and non-harmonic content are determined empirically. Also, and tendency of the harmonic content to change over time, and the temporal aspects of attack, sustain, and decay are likewise determined empirically. These attributes are represented in the invention in a percussive sound file which includes a harmonic content profile (502), noise shape filter (504), Doppler shift profile (506), and a time wave shaping profile (508). The harmonic content profile is used by an FM generator (114) to generate a frequency modulated signal (116). The noise shape profile is used by a noise generator (134) to generate and shape the non-harmonic spectral content. While the sound is being generated, the Doppler shift profile is used to adjust the base frequency of the FM signal. The harmonic and non-harmonic signals are scaled (142, 144) and summed (146). The summed signal is then shaped (150) in time to substantially simulate the attack, sustain, and decay properties of the sound. The shaped, summed signal is then played by an audio circuit and converted to an acoustic signal.

10 Claims, 5 Drawing Sheets

400

METHOD AND APPARATUS FOR GENERATING PERCUSSIVE SOUNDS IN EMBEDDED DEVICES

TECHNICAL FIELD

This invention relates in general to generating sounds electronically, and more particularly to generating sounds which simulate percussive sounds without using stored samples of the sounds sought to be so generated so as to substantially reduced the amount of memory needed to store parameters for generating such sounds.

BACKGROUND OF THE INVENTION

There are a number of methods in present use for generating music and sound electronically. Perhaps the most prevalent method is that of the Musical Instrument Digital Interface or MIDI. In MIDI devices musical instruments and sounds are specified in MIDI files and are generated via a sound synthesizer. Wavetable Synthesis is one technique where the instrument or sound is recorded, and digitally sampled. These samples make up files known as wave table files. The wave table files are used to recreate the sound of a given musical instrument, or other sound. Typically, when sampling a harmonic or tonal instrument, such as a piano or horn, for example, the instrument is sampled at several different tonal pitches. When the MIDI device generates pitches that are between those sampled, the device interpolates between the stored samples to arrive at the desired pitch. The tonal and harmonic content, as well as the temporal aspects of the sound are inherent in the samples. These qualities distinguish one instrument from another, one sound from another. Because these qualities are inherent in the wavetable synthesizer file, there is no need to model them. Instead, when a particular instrument sound is to be played, the MIDI device only needs to know the desired pitch, and interpolate between two stored pitches if necessary.

Tonal instrument sounds can be synthesized by frequency modulation (FM) techniques, where a given instrument can be modeled by one or more FM equations. FM techniques provide a way to create a reasonable facsimile of the sound of a particular tonal or harmonic instrument. However, FM techniques do not provide an acceptable means of recreating non-harmonic instruments and sounds, such as drums, cymbals, and other percussive sounds and sound effects such as a hand clap. For these sounds, wave table synthesis has been considered the better way for sound recreation. A standard MIDI system describes harmonic as well as percussion instruments. Thus, in order to generate faithful reproduction of music having percussion instrument sounds, wave tables will typically be used.

While the method of reproducing the sound of an instrument from a wave table is simple, and provides a qualitatively accurate reproduction, it requires an amount of memory not easily afforded in some embedded devices. An example of such an embedded device would be a cellular radiotelephone. Such devices are primarily designed for purposes other than generating music. However, in some markets, and in the mobile communication device market in particular, sound and music playing capability is offered as a market differentiator. Music can be used to provide an alert when an incoming call is being received, for example. Some manufacturers have designed communication devices which permit the user of the device to program tone sequences representative of songs into the device. However, because of the amount of memory needed to reproduce percussion sounds, the musical ability of such devices has been limited. Therefore there is a need for method of generating percussive sounds that uses substantially less memory than wave table techniques.

DETAILED DESCRIPTION OF A PREFERRED EMBODIMENT

Figure 1:
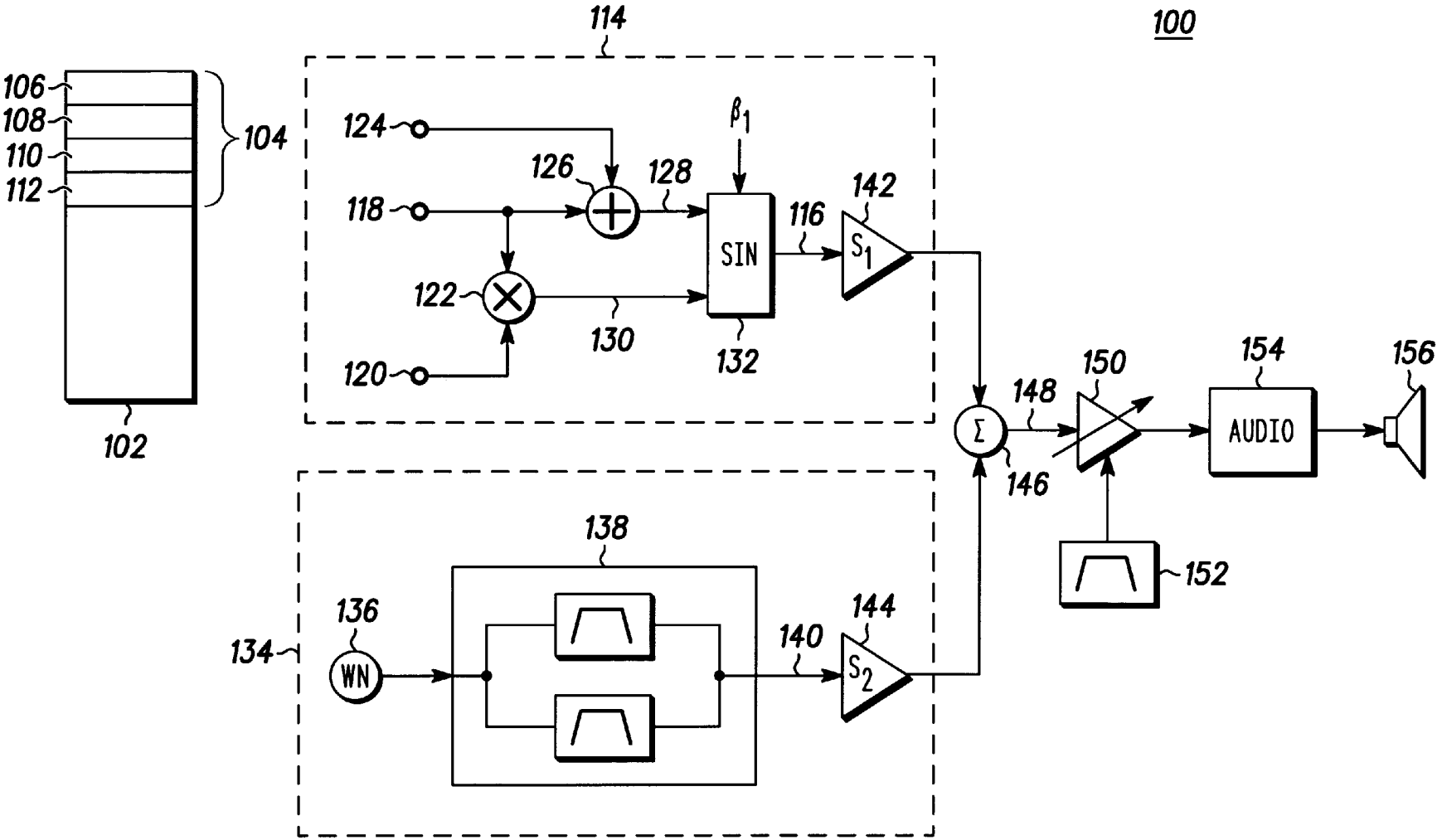
FIG. 1 shows a block diagram of music and percussive sound generating apparatus, in accordance with the invention.

While the specification concludes with claims defining the features of the invention that are regarded as novel, it is believed that the invention will be better understood from a consideration of the following description in conjunction with the drawing figures, in which like reference numerals are carried forward. A brief description of the prior art is also thought to be useful.

The invention solves the problem of providing a music and sound generating engine capable of generating percussive sounds without using wave tables or other stored samples of percussive sounds by combining white noise filtering techniques along with Doppler-shifted FM techniques and temporal wave shaping. Through examination in time and frequency spectral content of a desired percussive sound, one can characterize the sound in terms of white noise content, harmonic content, harmonic shift, and overall attack, sustain, and decay characteristics. The invention provides for a novel method of expressing these parameters so that the sound may be synthesized without the need for storing a wave table or other sample file. This substantially reduces the amount of memory needed to recreate the sound while providing a reasonably faithful reproduction of the original sound.

Referring now to FIG. 1, there is shown a block diagram of music and percussive sound generating apparatus 100, in accordance with the invention. The generating apparatus comprises a memory 102 for storing instrument and sound files, including at least one percussive sound file 104, which is an instrument specification file. The percussive sound file includes a noise shape filter 106, a Doppler shift profile 108, a time wave shaping profile 110, and a harmonic content profile 112. The Doppler shift profile and harmonic content profile are used by frequency modulated signal generator 114 for generating a frequency modulated signal 116 according to the harmonic content profile. The frequency modulated signal has a base frequency or initial frequency that is shifted over time according to the Doppler shift profile. The base frequency is provided in the form of a digital sinusoid signal at 118. A digital FM modulator to modulated signal ratio, which is stored in the harmonic content profile, is provided at 120. The base frequency 118 is multiplied with the ratio 120 at 122. The Doppler profile, which in the preferred embodiment is a single digital word, is provided at 124, and adds to, or subtracts from, the base frequency at 126, which provides a means for adjusting the base frequency of the frequency modulated signal according to the Doppler shift profile, with respect to time. The adjusted base frequency at 128 and the product of the unadjusted base frequency and the modulation ratio at 130 are both provided to a sinusoidal modulator 132. The modulator produces the frequency modulated signal 116. In practice, of course, these blocks represent functions performed on data by a digital processor or digital signal processor. This arrangement for frequency modulation, except the Doppler shift, is well known.

The frequency modulated signal generator provides the harmonic content of the percussive sound being generated, but percussive sound also has non-harmonic content. Generating the non-harmonic content has been problematic, and so wave tables or stored samples have been the preferred method for generating percussive sounds. The invention generates the non-harmonic content with a white noise signal generator 134. The white noise signal generator comprises a white noise generator 136, which is essentially a random number generator, for providing a raw white noise signal. The raw white noise signal is filtered by a means for filtering to achieve a desired spectral shape, according to the noise shape filter 106. The noise shape filter can be any number of conventional digital filters, arranged in parallel, to define as many noise shaped bands as needed. Generally, it has been found that it is preferable to have at least two infinite impulse response (IIR) filters 138, which operate in parallel to shape different portions of the noise spectrum, and which are then summed together. The result is a shaped white noise signal on line 140. The selection of filters depends upon the particular percussive sound sought to be generated. The design of the filter is performed by first analyzing the spectral content of the actual sound sought to be generated. This can be done by analysis of a digital sample of the sound. It has been found that such analysis will reveal the shape and location of the non-harmonic content of the sound, and thereby allow one to design a suitable filter to shape the raw white noise signal. Thus, the filters and harmonic content are selected empirically. The frequency modulated signal 116 and the shaped white noise signal are passed through scalers 142, 144, respectively. The scaling factors $S_1$ & $S_2$ of the scalers are also selected empirically, and in some instances are such that the magnitude of the frequency modulated signal is substantially larger than the magnitude of the shaped white noise signal.

After scaling the two signals are summed by a means for summing 146, thus providing a summed signal 148. The means for summing is operably coupled to the white noise signal generator and the frequency modulated signal generator, preferably by algorithmic flow since the summing will most likely be performed by the same digital processor that performs the function of most of the blocks in FIG. 1. The summed signal is then shaped by a means for shaping 150 the magnitude of the summed signal with respect to time according to the time wave shaping profile 110, 152 to provide a shaped summed signal. The means for shaping is somewhat like a time dependent scaling function. Finally, the shaped summed signal is provided to an audio circuit 154 that is operably coupled to the means for shaping. The audio circuit, in the preferred embodiment, receives a digital signal and converts the digital signal into an analog signal, and then into an acoustical signal through a speaker or audio transducer 156.

Figure 2:
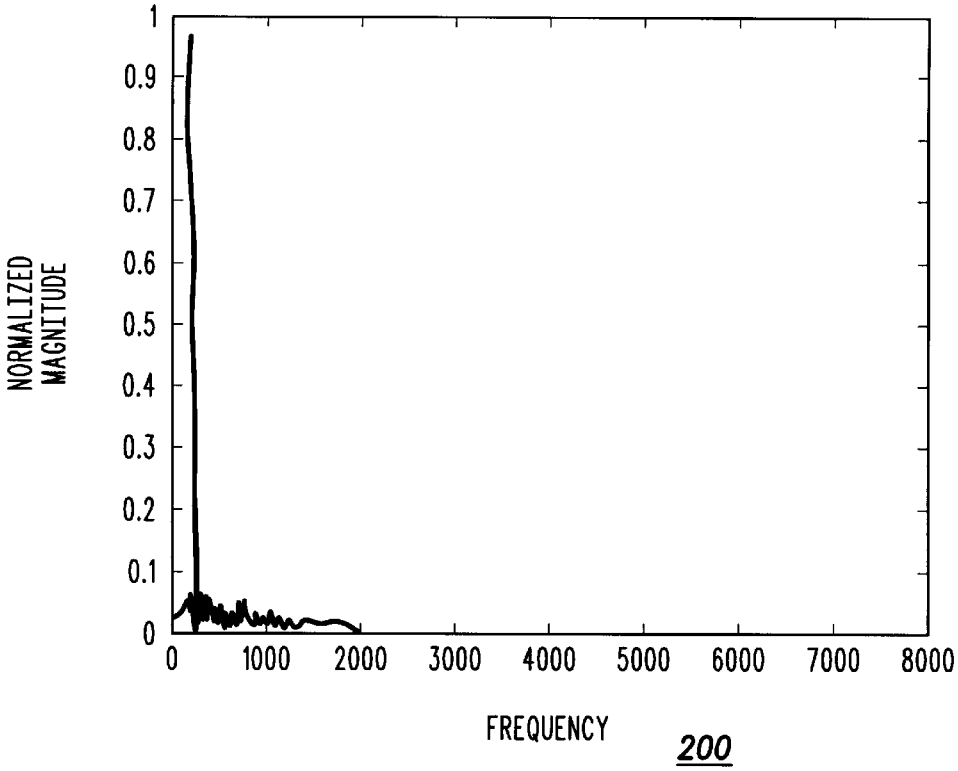
FIG. 2 shows a graph chart diagram of the frequency spectral content of a particular percussive sound.
Figure 3:
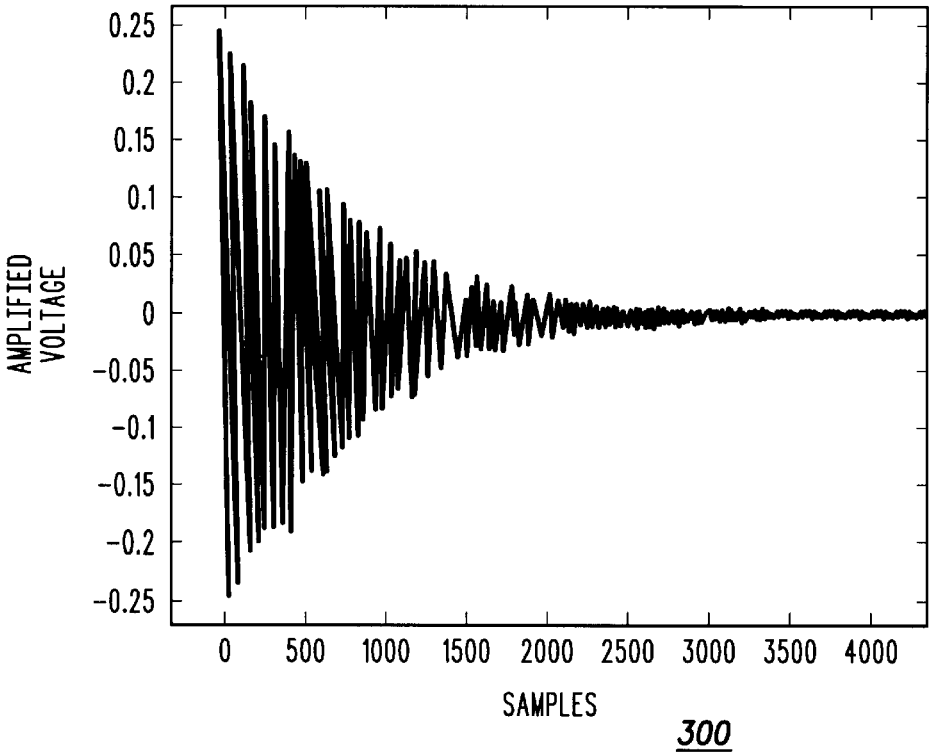
FIG. 3. shows a graph chart diagram of the amplitude over time of a particular percussive sound.
Figure 4:
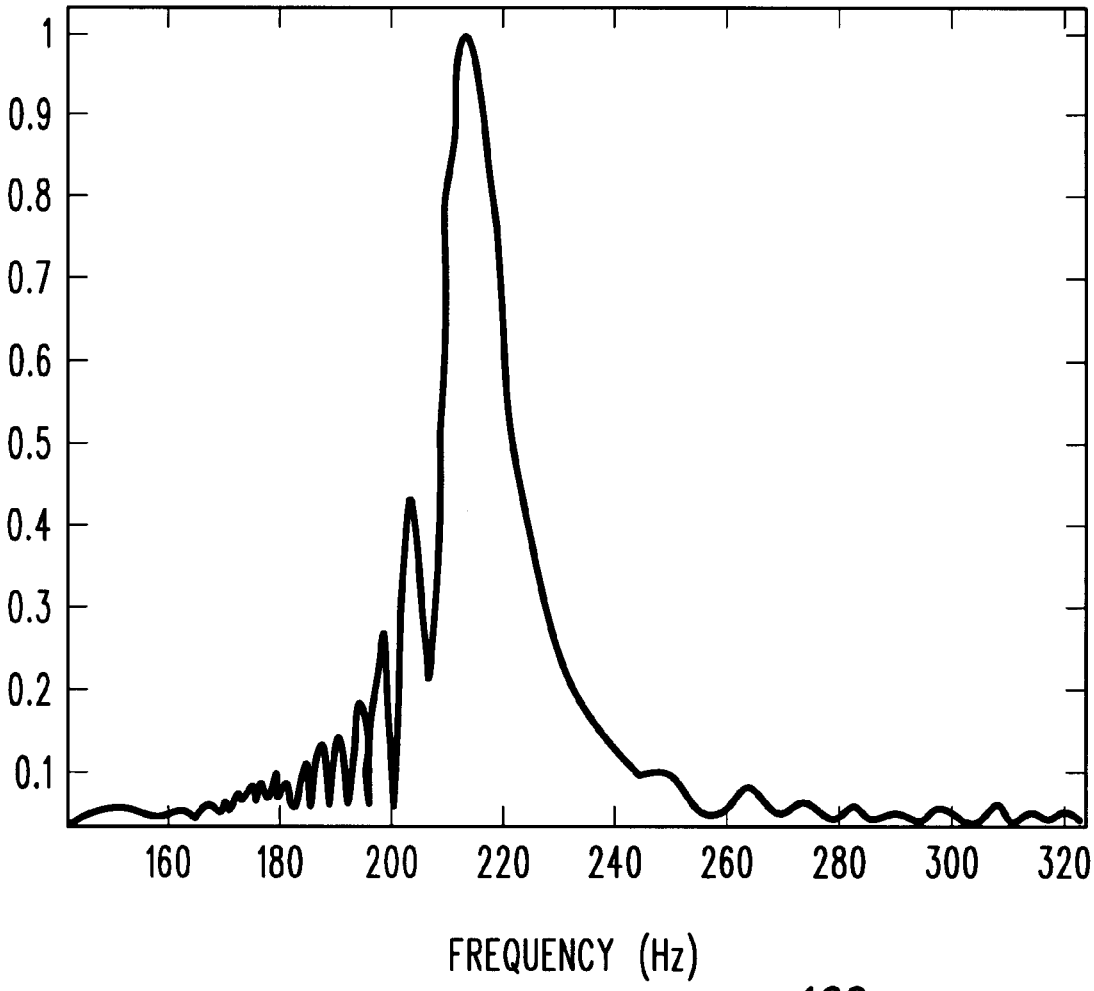
FIG. 4 shows the Doppler shift in frequency over time of a particular percussive sound.

Operating the percussive sound generating apparatus includes providing a percussive sound file corresponding to the desired percussive sound to be generated in the memory. By corresponding it is meant that the percussive sound file has been formulated by analyzing the particular sound to be generated, such as, for example, a snare drum, and determining the harmonic and noise content, and the temporal characteristics of the frequency shift of the harmonic content and the attack, sustain, and decay of the sound. These can be determined empirically in a routine manner. FIGS. 2–4 show different aspects of the sound of a snare drum being struck once. The sound has been sampled and analyzed.

FIG. 2 shows a graph chart of the frequency content of a snare drum strike, including both the harmonic and non-harmonic content. The graph has been normalized with respect to magnitude. From the graph it can be seen that the harmonic content is much greater in magnitude than the non-harmonic content. For this reason the scaling done in scalers 142 and 144 is such that the frequency modulated signal is much greater than the shaped noise signal with respect to magnitude. Furthermore, when analyzed, the frequency and modulation characteristics of the harmonic content, as well as the location and shape of the non-harmonic content can be discerned, and appropriate parameters selected.

FIG. 3 shows a graph chart of a the sound of a snare drum being struck, and the voltage produced over time in a recording device. From a graph such as this, one may decide on appropriate parameters for the time wave shaping profile filter. Typically the attack, sustain, and decay of the sound need to be modeled. The attack is the initial rise time, which, in a percussive sound, will typically increase at a very steep initial slope. The sustain is related to the persistence of the sound, and the decay describes the way in which the sound diminishes. The decay may have linear, exponential, or both linear and exponential characteristics.

FIG. 4 shows a graph chart of the normalized frequency response of a snare drum strike with respect to time. This chart shows the frequency response over the duration of the sound. The largest peak is the initial base frequency, and the smaller peaks to the left at lower frequencies illustrate how the frequency changes with time. The information yielded by this analysis allows one to select an appropriate frequency shift profile parameter to adjust the initial of base frequency of the frequency modulated signal over time.

Figure 5:
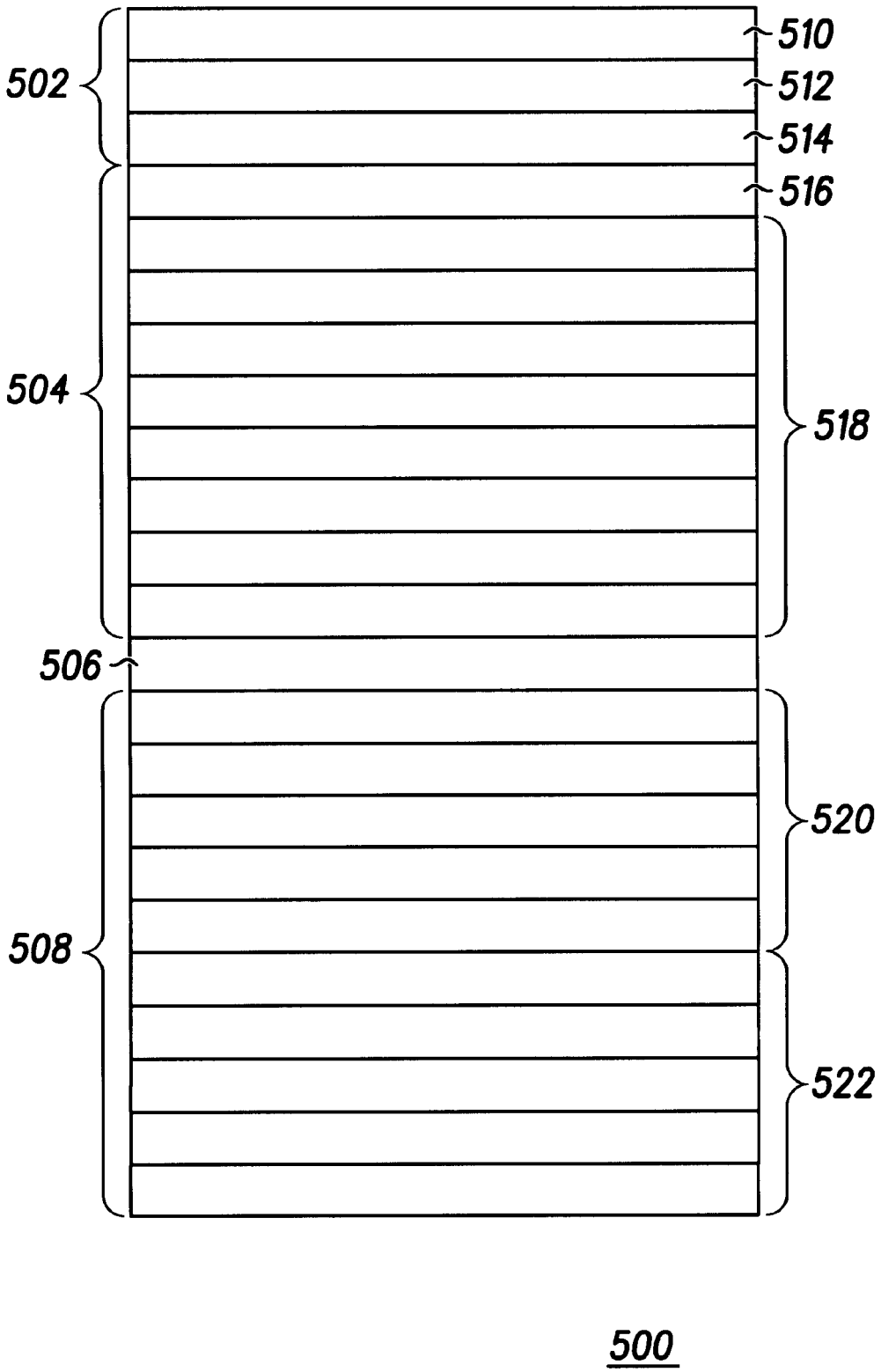
FIG. 5 shows a diagram of an instrument specification file, in accordance with the invention.

FIG. 5 shows a diagram of an instrument specification file 500, and in particular a percussive sound file, in accordance with the invention. The percussive sound file is a compilation of values, and the specific sound file shown here is meant to be representative of the values to be included for generating percussive sounds. Numerous other arrangements may be equally suitable. The percussive sound file contains a harmonic content profile 502, noise shape filter 504, a Doppler shift profile 506, and a time wave shaping profile 508. Thus, in the preferred embodiment, the percussive sound file comprises digital words used by the percussive sound generating apparatus shown in FIG. 1. The harmonic content profile 502 includes 3 digital words, including a harmonic generator scale value 510 used by the scaler 142 (scaling factor $S_1$), an FM operator beta, $\beta_1$, 512, and a modulator frequency to modulated frequency ratio 514. The noise shape filter 504 comprises 11 digital word values, one for a frequency scale factor $S_2$ 516, and ten words for the IIR filter taps that define the IIR filters 138 used to shape the white noise signal generated by white noise generator 136. The Doppler shift profile 506 comprises one word for a linear frequency change. It may be signed to indicate whether the desired frequency shift increases frequency or decreases frequency over time. Finally, the time wave shaping profile 508 comprises 8 words, four indicating the segment durations 520, and four indicating the segment slopes 522. The segments refer to the different time periods during which the different slopes are applied to the shape of the summed signal 148 to produce the summed shaped signal. Since the sound has a finite duration, the total duration of the segments is substantially equal to the duration of the sound as it would normally occur when heard from the actual instrument or source. The slopes of the segments control the attack, sustain, and decay of the sound, as determined empirically. The decay may be linear, exponential, or both. For example, in FIG. 3, it can be seen that the decay of the snare has a substantially exponential decay. Compared to a typical sample or wave table file used in conventional sound generating devices, the percussive sound file is much shorter and occupies far less memory space.

Figure 6:
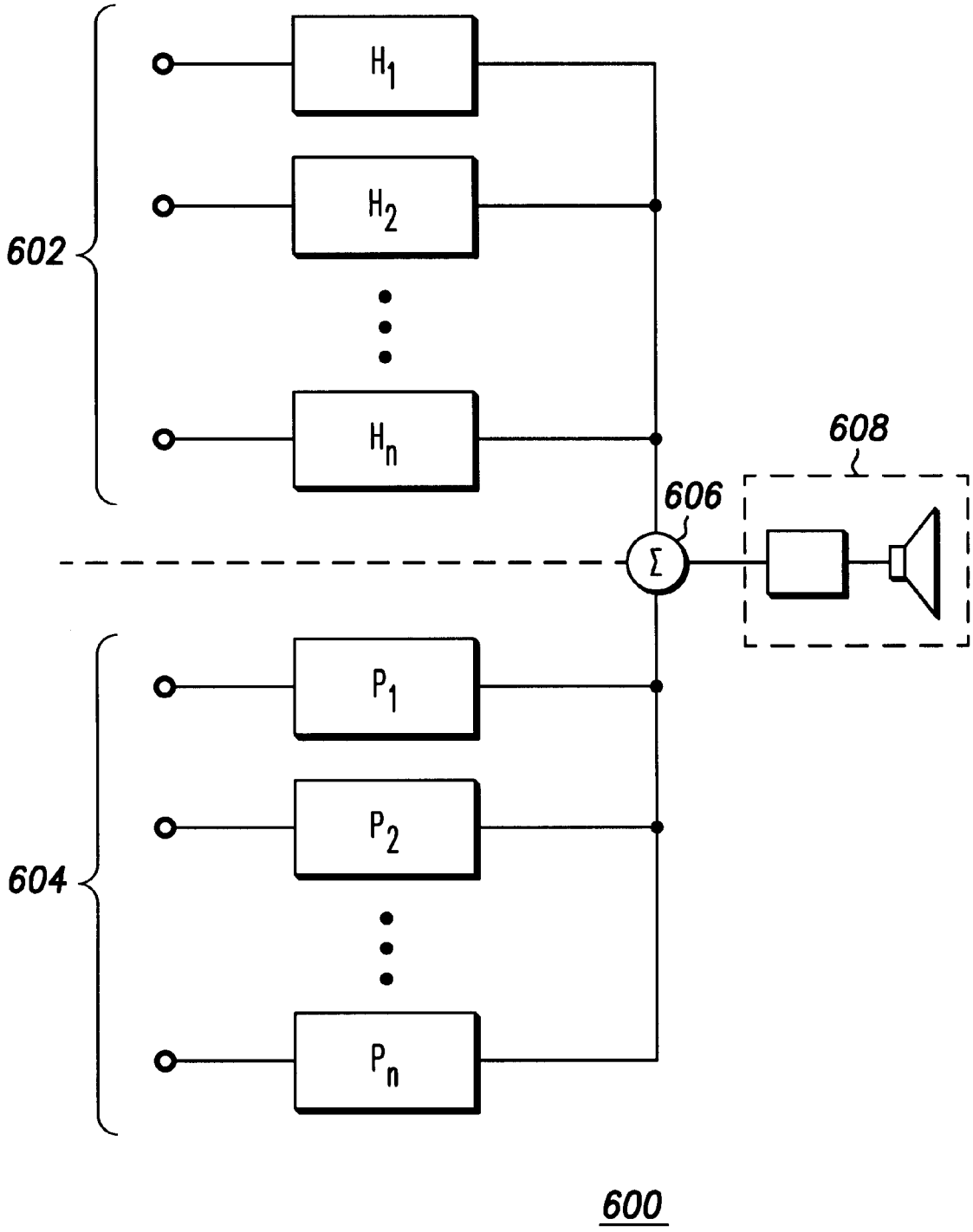
FIG. 6 shows a block diagram of a sound generating apparatus including harmonic sound generators and percussive sound generators in accordance with the invention.

FIG. 6 shows a block diagram of a music and sound generating apparatus 600, including a plurality of percussive sound generators in accordance with the invention. There are a plurality of harmonic sound generators 602, and a plurality of percussive sound generators 604. The signals generated by these different blocks are summed 606 and fed to an audio block for conversion to an acoustical signal. The harmonic sound generators are used to generate harmonic instrument sounds, such as piano, woodwind, brass, and other such sounds. Each block comprises a pair of FM generators similar to the harmonic sound generator 114 in FIG. 1. Each FM generator generates an FM signal which may be combined with another FM signal to produce a particular instrument sound. The percussive sound generator blocks are substantially the same as that shown in FIG. 1. A plurality of them are provided so that several different percussive sounds can be generated.

The method of operating the percussive sound generator includes generating a white noise signal with, for example, a random number generator, and filtering the white noise signal with respect to frequency according to the noise shape filter to provide a shaped white noise signal. At the same time the percussive sound generator commences generating a frequency modulated signal according to the harmonic content profile. The frequency modulated signal has a base or initial frequency, and is sinusoidal and may be referred to as a carrier wave. The carrier wave is modulated with another signal, preferably another sinusoid. The percussive sound generator may also perform scaling of the shaped white noise signal and the frequency modulated signal relative to each other, prior to summing the shaped white noise signal and the frequency modulated signal, such that the frequency modulated signal is substantially larger in magnitude than the shaped white noise signal. The harmonic and non-harmonic generators, 114 and 134, respectively, of FIG. 1, provide the frequency spectral content of the percussive sound. The temporal behavior of the sound is controlled by changing the base frequency and the attack, sustain, and decay properties over the duration of the sound.

The percussive sound generator performs the adjusting of the base frequency of the frequency modulated signal according to the Doppler shift profile, with respect to time. Typically the adjusting will be performed in a linear manner. A summer performs summing of the shaped white noise signal and the frequency modulated signal to provide a summed signal. The summed signal has a magnitude which is shaped or controlled by shaping the magnitude of the summed signal with respect to time according to the time wave shaping profile to provide a shaped summed signal. The percussive sound generator provides the shaped summed signal to an audio circuit whereby the shaped summed signal is converted into an acoustical signal corresponding to the desired percussive sound.

The invention therefore provides a method and apparatus for generating percussive sounds, while avoiding the use of conventional sample or wave table files which use a substantial amount of memory space. The invention combines means for generating the frequency spectral content, and means for adjusting the harmonic content as well as the attack, sustain, and decay, over time, of the sound. This method of generating percussive sounds is particularly suitable to embedded devices which typically have a small amount of memory relative to more sophisticated devices. While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. A method of generating a percussive sound in a device, the device having a memory, the method comprising:

providing in the memory a percussive sound file corresponding to a desired percussive sound, the percussive sound file having a noise shape filter, a Doppler shift profile, a time wave shaping profile, and a harmonic content profile;

generating a white noise signal;

filtering the white noise signal with respect to frequency according to the noise shape filter to provide a shaped white noise signal;

generating a frequency modulated signal according to the harmonic content profile, the frequency modulated signal having a base frequency;

adjusting the base frequency of the frequency modulated signal according to the Doppler shift profile with respect to time;

summing the shaped white noise signal and the frequency modulated signal to provide a summed signal, the summed signal having a magnitude;

shaping the magnitude of the summed signal with respect to time according to the time wave shaping profile to provide a shaped summed signal; and providing the shaped summed signal to an audio circuit whereby the shaped summed signal is converted into an acoustical signal corresponding to the desired percussive sound.

2. A method of generating a percussive sound as defined in claim 1, wherein generating the frequency modulated signal is performed by modulating a carrier wave at the base frequency with a sinusoidal signal.

3. A method of generating a percussive sound as defined in claim 1, wherein filtering the white noise signal with respect to frequency according to the noise shape filter comprises filtering the white noise signal with at least two infinite impulse response filters.

4. A method of generating a percussive sound as defined in claim 1, further comprising scaling the shaped white noise signal and the frequency modulated signal relative to each other prior to summing the shaped white noise signal and the frequency modulated signal such that the frequency modulated signal is substantially larger in magnitude than the shaped white noise signal.

5. A method of generating a percussive sound as defined in claim 1, wherein adjusting the base frequency of the frequency modulated signal according to the Doppler shift profile with respect to time is performed by linearly adjusting the base frequency.

6. A music and percussive sound generating apparatus for use in embedded applications, comprising:

a memory for storing instrument and sound files, including at least one percussive sound file, the percussive sound file having a noise shape filter, a Doppler shift profile, a time wave shaping profile, and a harmonic content profile;

a white noise signal generator for providing a white noise signal;

means for filtering the white noise signal with respect to frequency according to the noise shape filter to provide a shaped white noise signal;

a frequency modulated signal generator for generating a frequency modulated signal according to the harmonic content profile, the frequency modulated signal having a base frequency;

means for adjusting the base frequency of the frequency modulated signal according to the Doppler shift profile with respect to time;

means for summing the shaped white noise signal and the frequency modulated signal to provide a summed signal, the means for summing operably coupled to the white noise signal generator and the frequency modulated signal generator, the summed signal having a magnitude;

means for shaping the magnitude of the summed signal with respect to time according to the time wave shaping profile to provide a shaped summed signal; and an audio circuit, operably coupled to the means for shaping, whereby the shaped summed signal is converted into an acoustical signal corresponding to the desired percussive sound.

7. A music and percussive sound generating apparatus as defined in claim 6, wherein the frequency modulated signal generator modulates a carrier wave at the base frequency with a sinusoidal signal to provide the frequency modulated signal.

8. A music and percussive sound generating apparatus as defined in claim 6, wherein the means for filtering the white noise signal comprises at least two infinite impulse response filters.

9. A music and percussive sound generating apparatus as defined in claim 6, further comprising means for scaling the shaped white noise signal and means for scaling the frequency modulated signal relative to each other such that the frequency modulated signal is substantially larger in magnitude than the shaped white noise signal.

10. A music and percussive sound generating apparatus as defined in claim 6, wherein the means for adjusting the base frequency of the frequency modulated signal adjusts the base frequency linearly with respect to time.

* * * * *